US011442489B2

(12) United States Patent
Bonnici et al.

(10) Patent No.: US 11,442,489 B2
(45) Date of Patent: Sep. 13, 2022

(54) JOYSTICK COMPRISING A LEVER AND A HOUSING

(71) Applicant: Methode Electronics Malta Ltd., Birkirkara (MT)

(72) Inventors: Allen Carl Bonnici, Mosta (MT); Andrew Portelli, Msida (MT); Manuel Gatt, Siggiewi (MT)

(73) Assignee: METHODE ELECTRONICS MALTA LTD., Birkirkara (MT)

( * ) Notice: Subject to any disclaimer, the term of this patent is extended or adjusted under 35 U.S.C. 154(b) by 0 days.

(21) Appl. No.: 17/110,385

(22) Filed: Dec. 3, 2020

(65) Prior Publication Data

US 2021/0173426 A1 Jun. 10, 2021

(30) Foreign Application Priority Data

Dec. 5, 2019 (DE) ..... 10 2019 133 126.9

(51) Int. Cl.

| | |
|---|---|
| ***G05G 9/047*** | (2006.01) |
| ***G05G 5/03*** | (2008.04) |
| ***H01H 21/22*** | (2006.01) |

(52) U.S. Cl.

CPC ..... *G05G 9/047* (2013.01); *G05G 5/03* (2013.01); *G05G 2009/04755* (2013.01); *G05G 2505/00* (2013.01); *H01H 21/22* (2013.01)

(58) Field of Classification Search

CPC .. G05G 5/03; G05G 9/047; G05G 2009/0474; G05G 2009/04707; G05G 2009/04714; G05G 2009/04718; G05G 2009/04744; G05G 2009/04748; G05G 2009/04751; G05G 2009/04755; G05G 2505/00; H01H 21/22; H01H 21/285; H01H 25/04; H01H 36/008; H01H 2036/0093

See application file for complete search history.

(56) References Cited

U.S. PATENT DOCUMENTS

| | | | | |
|---|---|---|---|---|
| 4,161,726 A * | 7/1979 | Burson | ..... | G05G 9/047 200/6 A |
| 5,805,140 A * | 9/1998 | Rosenberg | ..... | G01B 5/008 345/161 |
| 6,480,183 B1 * | 11/2002 | Van Ruymbeke | ..... | G05G 9/047 324/660 |
| 6,704,001 B1 * | 3/2004 | Schena | ..... | G05G 9/047 310/12.04 |

(Continued)

FOREIGN PATENT DOCUMENTS

| | | |
|---|---|---|
| DE | 3504387 A1 | 8/1985 |
| DE | 102006014923 A1 | 10/2007 |

(Continued)

OTHER PUBLICATIONS

Co-Pending U.S. Appl. No. 16/001,620, filed Jun. 6, 2018.

*Primary Examiner* — Daniel D Yabut

(74) *Attorney, Agent, or Firm* — Thompson Coburn LLP

(57) ABSTRACT

A joystick has a lever and a housing. The lever is pivotable around a pivot axis. The joystick has a support plate carrying at least one sensor. The sensor has at least one coil generating a magnetic field. An eddy current is induced into the coil. At least one metal flag is movable relative to the coil. The motion of the metal flag coincides with the tilting motion of the lever.

18 Claims, 6 Drawing Sheets

(56) References Cited

U.S. PATENT DOCUMENTS

| | | | | |
|---|---|---|---|---|
| 2008/0148894 | A1* | 6/2008 | Rapin | F16H 61/24 74/473.21 |
| 2008/0245650 | A1 | 10/2008 | Kramlich | |
| 2009/0084214 | A1 | 4/2009 | Sakai et al. | |
| 2010/0265176 | A1* | 10/2010 | Olsson | G05G 9/047 345/161 |
| 2015/0377648 | A1 | 12/2015 | Sirohiwala et al. | |
| 2018/0356854 | A1 | 12/2018 | Spiteri | |

FOREIGN PATENT DOCUMENTS

| | | | |
|---|---|---|---|
| DE | 102011102796 | A1 | 11/2012 |
| DE | 102014108195 | A1 | 1/2015 |
| JP | 2011258389 | A | 12/2011 |

* cited by examiner

JOYSTICK COMPRISING A LEVER AND A HOUSING

RELATED APPLICATION DATA

This application claims the benefit of German Patent Application DE 10 2019 133 126.9, filed on Dec. 5, 2019, currently pending, the disclosure of which is incorporated by reference herein.

FIELD OF THE TECHNOLOGY

The disclosure refers to a control device that is adapted and configured to be electrically connectible to a power operated devices. The control device comprises at least one body, at least one haptic profile, at least one pair of movable metal flags with variable geometry, and at least one sensor electronics with planar coils. In the following description, the sensor electronics will be referred to a sensor.

BACKGROUND AND SUMMARY

The US 2018/0356854 A1 reveals a joystick which includes a stick and a base attached to the stick. The joystick includes a housing in which part of a base is disposed. The joystick further includes a sensor for detecting rotation of the base around at least one of the predetermined number of pivot-axes.

Electromechanical contacting systems known from the state of the art are subject to wear and tear over the lifetime of the joystick.

Also, with electromechanical contacting systems the amount of diagnostics one can do is limited.

Therefore, it is the object of the disclosure to provide a control device of which the arrangement of the sensor and the coil does not lead to a loss of energy.

The object is solved by a control device which is electrically connectable to power devices.

The control device comprises at least one body.

In the following, the body is refer to as lever.

Although, the control device has at least one haptic profile. The control device further comprises at least a pair of movable metal flags. The metal flags have a variable geometry.

The sensor of the control device further comprises at least one planar coil.

The lever is pivotable around a central pivot point and linked to the at least one haptic profile. Thus, the haptic profile provides tactile feedback to the user when the lever is actuated around the central pivot point. The lever can return to its neutral state in a repeatable manner. The neutral state may be the upright position of the lever.

The lever may be linked or connected to the at least a pair of metal flags in a direct manner.

It goes without saying that the link or connection between the lever and the at least a pair of metal flags can also be effected in an in-direct manner.

The combined motion of the flags provide a directional control.

The directional control is executed according to the formula:

R=distance from central position.

ϕ=angular position.

$$R=\sqrt{(x^2+y^2)};\ \phi=\tan^{-1}(y/x)$$

The planar coils of the sensor are arranged parallel to the at least a pair of metal flags.

According to the disclosure the planar coils are capable of generating Eddy currents.

The variable geometry of the at least two metal flags coupled with the oscillating magnetic field causes the Eddy currents to vary.

Thus, the magnetic field is created by the sensor electronics through at least one coil.

The at least one metal flag pair is moveable relative to the coil. The motion of the metal flag however coincides with the tilting motion of the lever.

Control Device and Body (Lever)

The control device comprises at least one body. The body may be referred to as a lever.

The control device is electrically connectable to a larger complex system.

The larger complex system may be configured to control the motion of various power operated devices.

The devices can be propelled through electrical power and/or hydraulic power and/or pneumatic power or a combination of.

By way of example and not in any limiting sense, the control device can be implemented to any heavy industry equipment such as bulldozers, cranes, lifters, cherry pickers, dump trucks and/or logging equipment.

The lever is pivotable around a central pivot point.

The lever is linked to the at least one haptic profile.

Both the lever and the haptic profile are referred to in detail below.

The body is adapted and configured to return to its neutral position in a repeatable manner. The neutral position may be an upright position of the lever or may be any other position. The neutral position is also called rest position.

The return of the lever from a position of the lever tilted around the pivot point back to the lever's rest position is effected by a single or multiple haptic profile(s).

The haptic profile is effected by a spring loaded mechanism and/or a set of magnets both of which are referred to in details further below.

When tilted around the central pivot point, the lever is turned into a rotary motion.

Due to the operative connection of the lever and the flags, during the tilting of the lever, the rotary motion of the lever is translated into a linear motion of the flags.

The translation of the rotary motion of the lever into a linear motion of the flags is also due to the fact that a main housing is operatively connected to the lever, the pivot point, and the flags.

The lever of the control device can be manufactured as a control column. The lever of the control device can be arranged in the cockpit of any civilian or military vehicle on land or on water or in the air.

The lever can be a center stick, arranged vertically. It can also be a side stick, arranged in a horizontal manner.

The lever can have supplementary switches, buttons or controls to control further aspects of the vehicle.

It goes without saying that the control device and its lever can also be used to control video games and game consoles.

As shown in the drawings and described above, in its rest or neutral position, the lever of the control device is arranged in an upright position.

The lever of the control device can be adapted as a one-directional lever. Alternatively, the lever can also be tilted in more than two directions.

Central Pivot Point

The control device is provided with a central pivot point.

The central pivot point forms part of a housing which is referred to in more detail below.

Relative to its rest position, the user may tilt the lever in any direction around the pivot point. In order to tilt the lever, the user pushes the lever into the desired direction at its far or distal end, which is opposite to the pivot point.

Through its pivot point, the lever is connected with the housing of the control device. Thus, the housing follows the pivoting motion of the lever when pushed in any of the pivot directions.

Due the fact that the housing is operatively linked or connected to the metal flags, the rotary motion of the lever is translated into a linear motion.

Housing

According to the disclosure, the housing is a rigid casing that encloses and protects a piece of moving or delicate equipment.

The disclosure reveals that the housing connects the pivot point of the lever with a haptic profile.

The housing also connects the lever with a slider carrying at least one metal flag. Thus, the slider connects the lever to the at least one metal flag in an indirect manner. Being physically connected with the lever through the pivot point, the housing follows the pivoting motion of the lever.

At either side of the lever the housing has at least one haptic profile and/or at least one slider (referred to below). The slider carries at least one metal flag.

With the housing being linked with the lever, both the slider and a haptic profile follow the pivoting motion of the lever.

Through means of the slider, at the end of the lever adjacent to the support plate, the lever is mechanically engaged to the at least one insert molded metal flag.

Slider

To follow the pivoting motion of the lever, the slider is linked with the lever via the housing. The at least one metal flag is mechanically fixed to the corresponding slider. Thus, the at least one slider carries at least one metal flag.

Relative to the sensor fixed to the support plate, at least one metal flag follows the pivoting motion of the lever.

Pivoting around the pivot point, the lever shows a rotary motion.

The rotary motion of the lever results in lifting the slider and the metal flags linearly off the support plate in the direction towards the end of the lever at the widest distance of the lever relative to the support plate.

When the slider is lifted up linearly in the direction to the end of the joystick at its widest distance relative to the support plate, the slider is moved linearly relative to the sensor.

Thus, the motion of the slider and/or the motion of the at least one metal flag arranged parallel to the sensor, translates the rotary motion of the lever into a linear motion of the metal flag and/or into a linear motion of the slider.

According to the disclosure, the slider provides metal flags on either side of the sensor.

As stated above, by means of the slider, the metal flags are linked with the housing and/or with the lever in on in-direct manner.

Thus, when the slider is moved relative to the sensor following the pivoting motion of the lever, the cumulative distances between the at least two longitudinal sides of the sensor and the at least two adjacent metal flags on either side of the sensor remains the same.

In other words, each slider is provided with a shoulder linking two slider arms with each other.

At the side, showing towards the sensor, each slider arm carries a metal flag each. Thus, on either side of the sensor, each slider arm carries at least one metal flag.

On either side of the sensor, the slider arm and its metal flag are arranged orthogonally relative to the sensor and/or to the coil.

When the slider arms follow the tilting motion of the lever, the rotary motion of the lever is translated into a linear motion of the slider arms and its metal flags in the direction in which the lever is being tilted.

Following the tilting motion of the lever, the cumulative value of the distances between each longitudinal side of the sensor and the adjacent metal flag and/or the adjacent slider arm, respectively, remains the same.

The slider arms follow the rotary motion of the lever. Thus, the distance between one slider arm and the adjacent longitudinal side of the sensor decreases by a defined value "A".

Simultaneously the distance between the other slider arm and the adjacent longitudinal side of the sensor increases by a value "B". However, the cumulative overall sum of the distances "A" and distance "B" remains the same.

In other words, the at least two metal flags are linked with the lever by means of the slider. When the slider is turned into a rotary motion, being connected with the lever, the flags follow motion of the slider.

Metal Flags and Sensor

As referred to above, in the rest position of the lever the at least one metal flag is arranged orthogonally relative to the sensor.

Due to the metal flag being fixed to the slider, the metal flag is arranged orthogonally relative to the slider.

The metal flags can be made of any metal capable of conducting electricity at a temperature of absolute zero. The disclosure refers to any malleable and/or ductile metal. The metal may be an iron alloy or any stainless steel.

Further, the disclosure refers to a sensor having a sensor body. The sensor is a device, a sensor module or any sensor subsystem, the purpose of which is to detect an event or a change in its environment.

To fit into any recess of the slider, the moveable metal flag has a variable geometry. Thus, the metal flag can have any desired size and shape.

According to the disclosure, the combined motion of the at least two flags provide a directional control.

The directional control is calculated as follows:

R=distance from central position.

$\phi$=angular position.

$$R=\sqrt{(x^2+y^2)};\ \phi=\tan^{-1}(y/x)$$

The combined motion of the flags provide directional control in the respective plane with every unique position adopted.

The variable geometry of the respective flag couples with an oscillating magnetic field.

As the before, the oscillating magnetic field is generated through the sensor electronics and it planar coils, wherein the planar coils are oriented in a parallel direction relative to the flags.

A proportional generation of eddy currents causes an energy loss. This energy loss can be converted into a $\Delta x$ or a $\Delta y$-value.

In order to protect against unwanted motion of the metal flag, the relation of $\acute{\varepsilon}x$ relative to $\acute{\varepsilon}y$, resulting in an erroneous output in a respective direction of X relative to Y, a flag on each side of the coil is arranged.

In one embodiment of the disclosure that at least a pair of flags are linked moveable with the lever in a direct manner.

According to another embodiment of the disclosure the at least two metal flags are linked with the lever by means of this slider. Thus, that metal flags are linked to the lever in an indirect manner.

According to another embodiment of the disclosure, the flags are aggregated as a set of insert molded flags.

The sensor sends the detected information to other electronics of the device. By way of example, such other electronics can be a computer processor or any other electronic equipment. Therefore, a sensor is frequently linked with other electronic components.

A sensor can be implemented as a set of electrically independent electronics such as a printed circuit board assembly (PCBA).

To increase work safety, independent PCBAs are implemented to control each other in order to guarantee the safety integrity level of the sensor implemented into the control device. The control device according to the disclosure is implemented into the end control safety critical equipment.

Coil and Eddy Current

As stated above, the disclosure provides at least one coil. By way of example, the disclosure refers to a planar coil.

According to the disclosure the control device relies on the at least one coil of the sensor to which eddy current principle is applied. Thus, the control device makes use of a contactless eddy current method to indicate the tilt angel of the lever.

According to the disclosure, eddy currents are loops of an electrical current induced within conductors by a changing magnetic field in the conductor. Eddy currents flow in closed loops within conductors, wherein planes of eddy current are perpendicular to the magnetic field.

The eddy current creates a magnetic field opposing the change in the magnetic field which created it. Thus, eddy currents vary to the source of the magnetic field.

The sensor and the planar coils cooperate to generate an oscillating magnetic field. The magnetic field is oriented in a parallel direction relative to the metal flags.

According to the disclosure, the respective metal flag has a variable geometry. Due to the variable geometry, the individual metal flag couples with the oscillating magnetic field generated by means of the sensor electronic and/or the at least one planar coil.

The disclosure provides at least one coil arranged in the plane of the sensor.

The coil is referred to as a passive two-terminal electrical component which stores energy in a magnetic field. Storing energy takes place in the coil when electric current flows through the coil.

The proportional generation and application of the Eddy current to the coils of the sensor prevents the energy loss, referred to above.

In other words, the at least one sensor carries at least one planar coil. The planar coil is oriented parallel to the at least two metal flags arranged adjacent to the sensor. The metal flags are carried by the slider.

The proportional generation and application of the eddy current to the coils of the sensor prevents the energy loss referred to above.

The assembly of the sensor and the at least one coil generates the Eddy current.

Haptic Profile and Spring Load Mechanism

At the end of the lever looking towards the support plate, opposite to the slider, the housing provides at least one haptic profile.

Relative to the pivot point of the lever the slider is arranged opposite to the haptic profile.

The haptic profile provides a tactile feedback to the user when the lever of the control device is tilted relative to the pivot point.

Also, the haptic profile allows the lever to return to its rest position after being tilted around the pivot point.

To return to its rest position, the haptic profile is adapted as a spring loaded mechanism (referred to above). At least one spring of the spring load mechanism pushes the lever back into its rest position.

The haptic profile can be a set of magnets arranged to provide a tactile feedback to the user when the lever is tilted around the pivot point.

The haptic profile can be an integral geometry of the housing. Alternatively, the haptic profile is designed as an independent component which is rigidly fixed to the housing.

BRIEF DESCRIPTION OF THE DRAWINGS

Further optional features of the joystick and its lever are set forth in the following description of the figures. The described features can in each case be realized individually or in any desired combinations. Accordingly, the joystick and its components are described below with reference to the drawings and on the basis of illustrative embodiments.

In the drawings.

DETAILED DESCRIPTION

Figure 1:
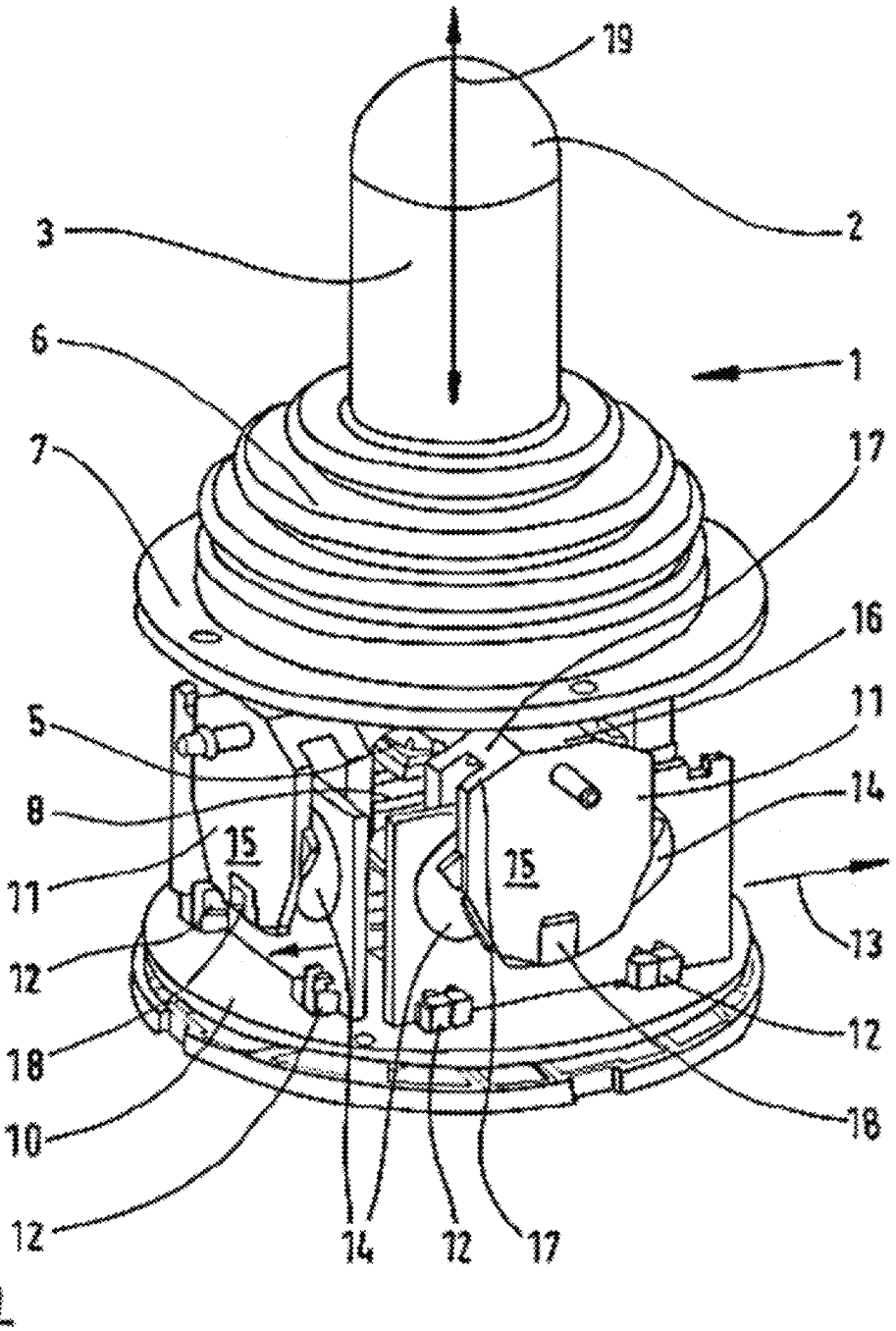
FIG. 1 shows a perspective view of a joystick 1.

Arranged in an orthogonal manner in FIG. 1 the joystick 1 has a lever 2 with an upper end 3 of the lever 2 protruding from the joystick 1.

A lower end 4 (FIG. 2) of the lever 2 is linked with a housing 5 of the lever 2.

The joystick 1 has a collar 6 sealing a cover 7 of the joystick 1 towards the exterior 9 of the lever 2.

The cover 7 closes an interior 8 of the joystick towards to its surrounding exterior 9.

Parallel to the cover 7 the joystick 1 has a support plate 10.

The support plate 10 is adapted as a bottom of the joystick to close the interior 8 of the joystick towards its exterior.

In FIG. 1 the support plate 10 carries four sensors 11 (only two of which can be seen in FIG. 1).

Each sensor 11 has at least two pairs of sockets 12 to fix the sensor 11 to the support plate 10.

In a plane 13 of the sensor 11, the sensor 11 provides two coils 14 each.

In the sockets 12 the sensor 11 is arranged in an upright position relative to the support plate 10.

In FIG. 1, each sensor 11 carrying at least two coils 14 is allocated a slider 15.

Each slider 15 is provided with a shoulder 16 linking two slider arms 17 with each other.

Adjacent to the longitudinal sides 23, 24 of the sensor 11, each slider arm 17, 28 carries a metal flag 18, respectively.

On either longitudinal side 23, 24 of the sensor 11 the slider arm 17, 28 and its respective metal flag 18 is arranged orthogonally relative to the sensor 11 and the coil 14.

The at least one coil 14 extends in the plane 13 of the sensor 11.

In the interior 8 of the joystick 1, the slider 15 is linked with the housing 5.

Being linked with the lever 2 of the joystick 1, the housing 5 follows the tilting motion of the lever 2.

When the lever 2 is tilted relative to the pivot axis 19, the slider 15 and the two slider arms 17 follow the tilting motion of the lever 2 relative to the sensor 11.

Thus, the rotational motion of the lever 2 relative to the pivot axis 19 is translated into a linear motion of the slider arms 17 of the slider 15 relative to the sensor 11.

Figure 2:
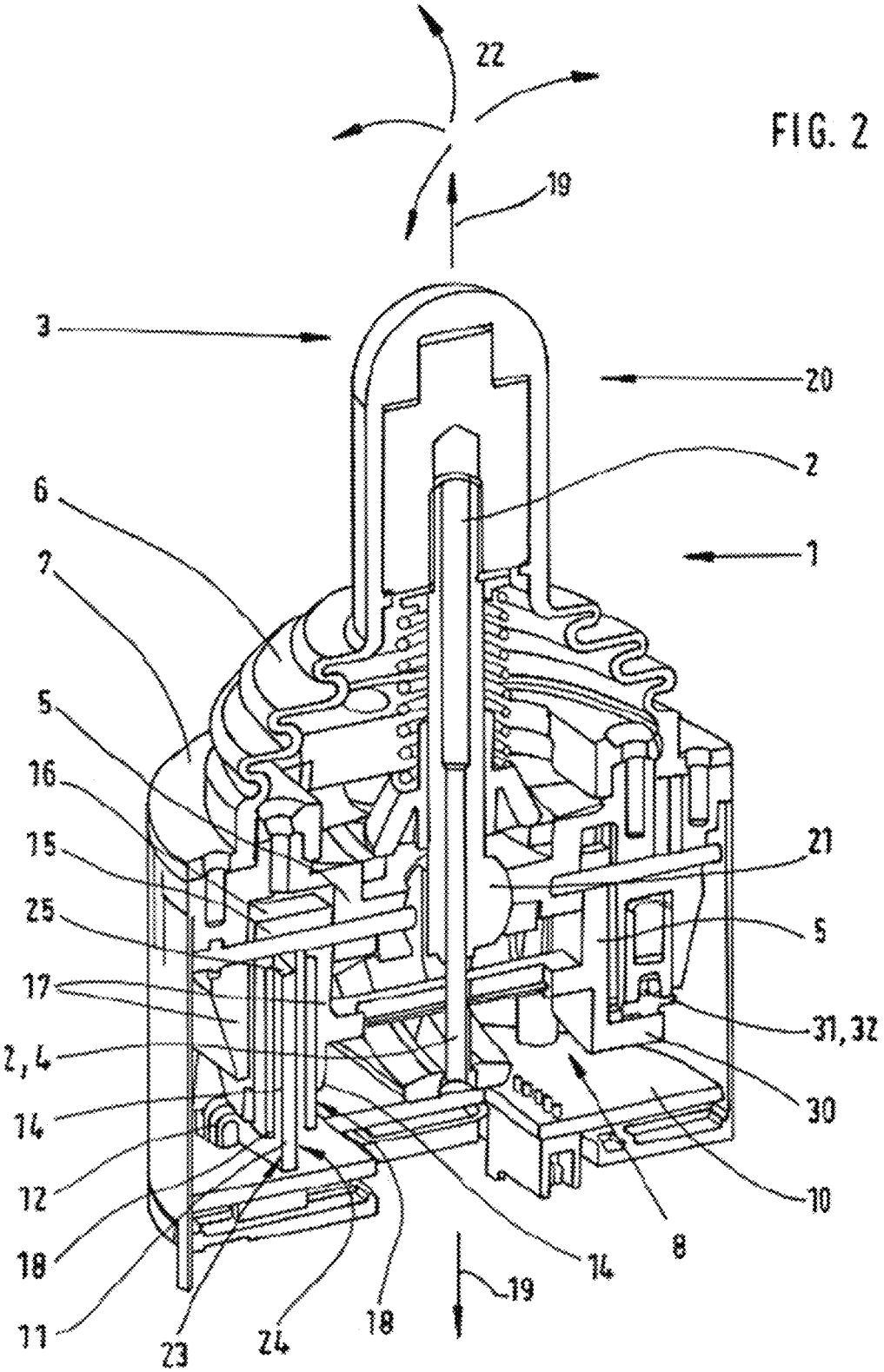
FIG. 2 shows the joystick according to FIG. 1, cut through the lever 2.

FIG. 2 shows the joystick 1 according to FIG. 1, cut through the lever 2.

In the FIG. 2 the lever 2 is shown in the rest position 20 with the lever 2 depicted in an upright position.

The upper end 3 of the lever 2 protrudes through the collar 6, whereas the lower end 4 of the lever 2 is positioned adjacent to the support plate 10.

In FIG. 2, the collar 6 links the cover 7 of the joystick 1 with the lever 2 to protect the interior 8 of the joystick 1 from penetrating fluid and/or unwanted particles.

The lever 2 has a pivot point 21.

The pivot point 21 is part of the housing 5 of the joystick 1.

When the lever 2 is tilted relative to the pivot axis 19 the housing 5 follows the tilting motion 22 of lever 2.

The housing 5 is linked with the slider 15.

In the FIG. 2 the slider 15 shows two slider arms 17, linked with each other by means of the shoulder 16.

The slider 15 overlaps the sensor 11 in that either slider arms 17 are arranged each orthogonally relative to each longitudinal sides 23, 24 of the sensor 11.

The shoulder 16 bridges a front side 25 of the sensor 11.

Facing towards the sensor 11, each slider arm 17 is provided with a metal flag 18. The sensor 11 has at least one coil 14 arranged in the plane 13 of the sensor 11.

Thus, the longitudinal sides 23, 24 of the sensor 11 and the coils 14 are arranged orthogonally relative to the metal flags 18.

Also, the longitudinal sides 23, 24 of the sensor 11 and the coils 14 are arranged orthogonally relative to the slider arms 17 of the slider 15.

In FIG. 2 the sensor 11 is fixed to the support plate 10 by means of sockets 12.

The sensor 11 is arranged in an upright position fixed to the support plate 10.

On the opposite side of the slider 15 relative to the longitudinal axis 19 of the lever 2, FIG. 2 shows a haptic profile 30 which is linked with the housing 5 of the joystick 1. In the FIG. 2 the haptic profile 30 protrudes from the housing 5 of the joystick 1 in a right angle, relative to the lever 2.

Being linked with the housing 5, the haptic profile 30 follows the tilting motion of the lever 2. The haptic profile 30, following the tilting motion of be housing 5 interacts with a spring load mechanism 31.

A spring 32 of the spring load mechanism 31 returns the lever 2 back into its rest position 20.

The spring 32 of the spring load mechanism 31 returns the housing 5 out of a tilted position into the rest position 20 of the lever 2.

Figure 3:
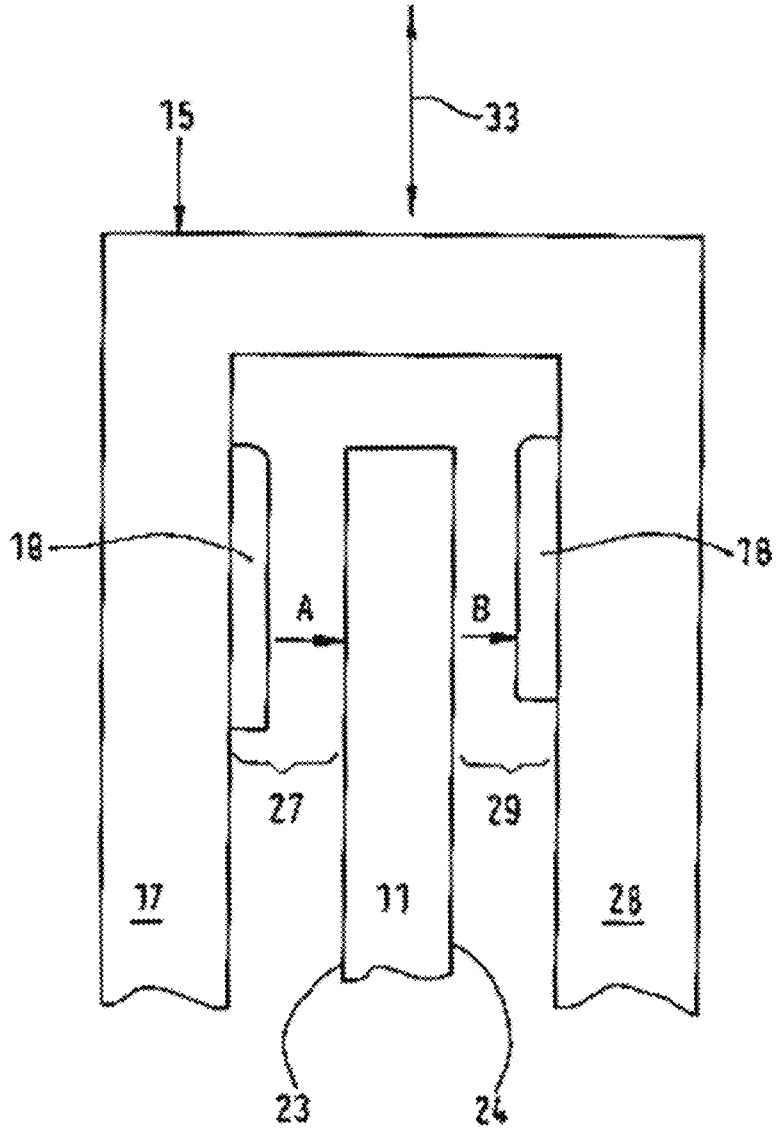
FIG. 3 shows schematically one sensor positioned between two arms of the slider.

FIG. 3 shows the position of the slider 15 overlapping the sensor 11 with the distance between the slider arm 17 and the longitudinal side 23 of the sensor 11 shown by reference 27.

On the other hand a distance between the slider arm 28 and the longitudinal side 24 of the sensor 11 is given a reference number 29.

FIG. 3 shows two sensors 11 positioned in a right angle relative to each other.

Each sensor 11 comprises a coil 14 (not shown).

Opposite to the longitudinal sides 23, 24 of the sensor 11, the slider 15 shows two slider arms 17, 28 each.

The tilting motion of the slider 15 and the tilting motion of the metal flags 18, respectively is shown by a double arrow 33.

When the slider arms 17, 28 follow the tilting motion of the lever 2 and the housing 5 respectively, (not shown in the FIG. 3), the FIG. 3 shows that the cumulative sum of the distance 27 and the distance 29 remains the same.

A combined motion of the metal flags 18, shown by the arrow 33 provides a directional control in the respective direction.

When the slider arms 17, 28 follow the tilting motion of the lever 2 the rotary motion of the lever 2 is translated into a linear motion of the slider arms 17, 28 in the direction in which the lever 22 is being tilted.

Following the tilting motion of the lever 2 the cumulative value of the distance 27 and the distance 29 remains the same.

In other words, the slider arms 17, 28 follow the rotary motion of the lever 2. Thus the distance 27 between the slider arm 17 and the longitudinal side 23 of the sensor 11 decreases by a value "A".

Simultaneously the distance 29 between the slider arm 28 and the longitudinal side 24 of the sensor 11 increases by a value "B". The cumulative overall sum of "distance 27" plus "distance 29" remains the same, when the slider 15 follows the tilting motion of the lever 2.

Figure 4:
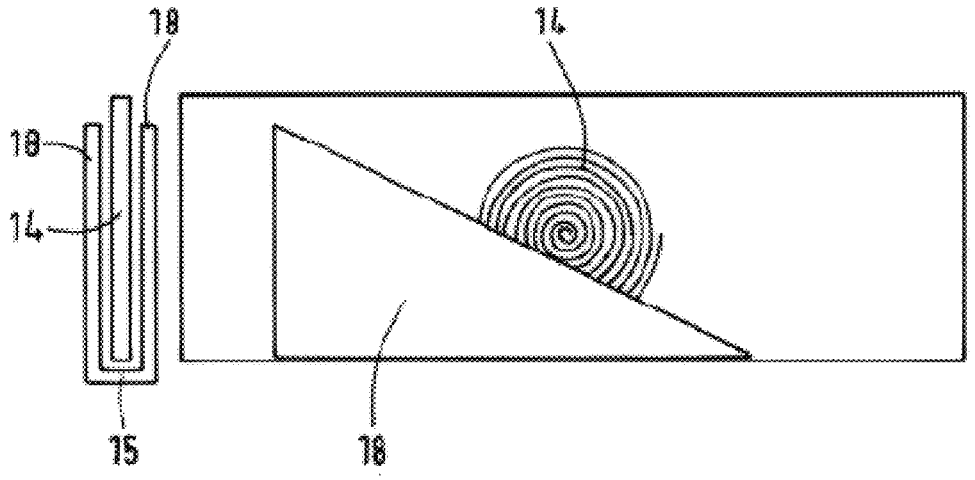
FIG. 4 shows a varying geometry, sliding in front of a planar coil.

FIG. 4 shows a varying geometry according to the disclosure, sliding in front of at least one planar coil 14.

Thus varying a coupled surface area as it moves forward and backwards.

Figure 5:
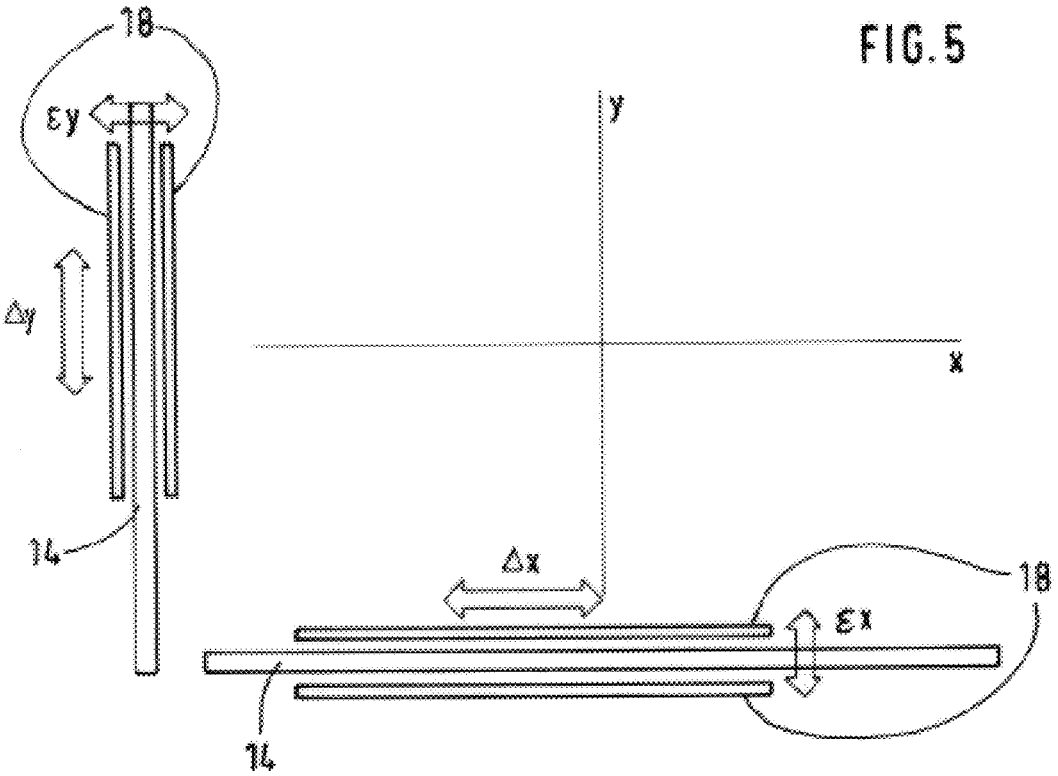
FIG. 5 shows two sensor layers according to the disclosure, FIG. 6 explains absolute values x and y referring to the sensors.

FIG. 5 shows two sensor layers, which run orthogonal to each other. Vertical travel however, is defined as ($\Delta y$) whereas horizontal travel is defined as ($\Delta x$).

The movement represented by $\varepsilon y$ and by $\varepsilon x$ represents an undesired movement. The undesired movement is provided for by having a pair of flags 18 for every sensor coil 14.

Figure 6:
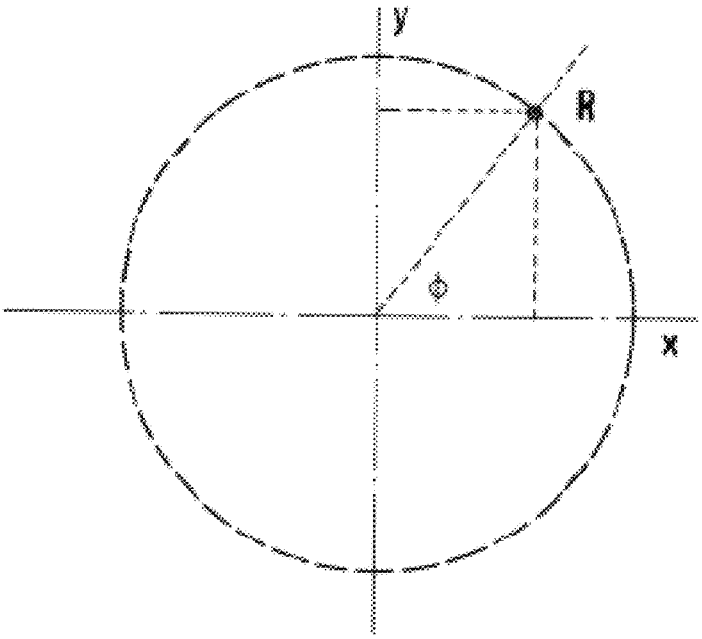

FIG. 6 explains how absolute values are defined through x and y deriving from the sensors 11. Combined motions of the flags 18 provide directional control positions in the respective plane 13 with every unique position represented by R and (I).

Figure 7:
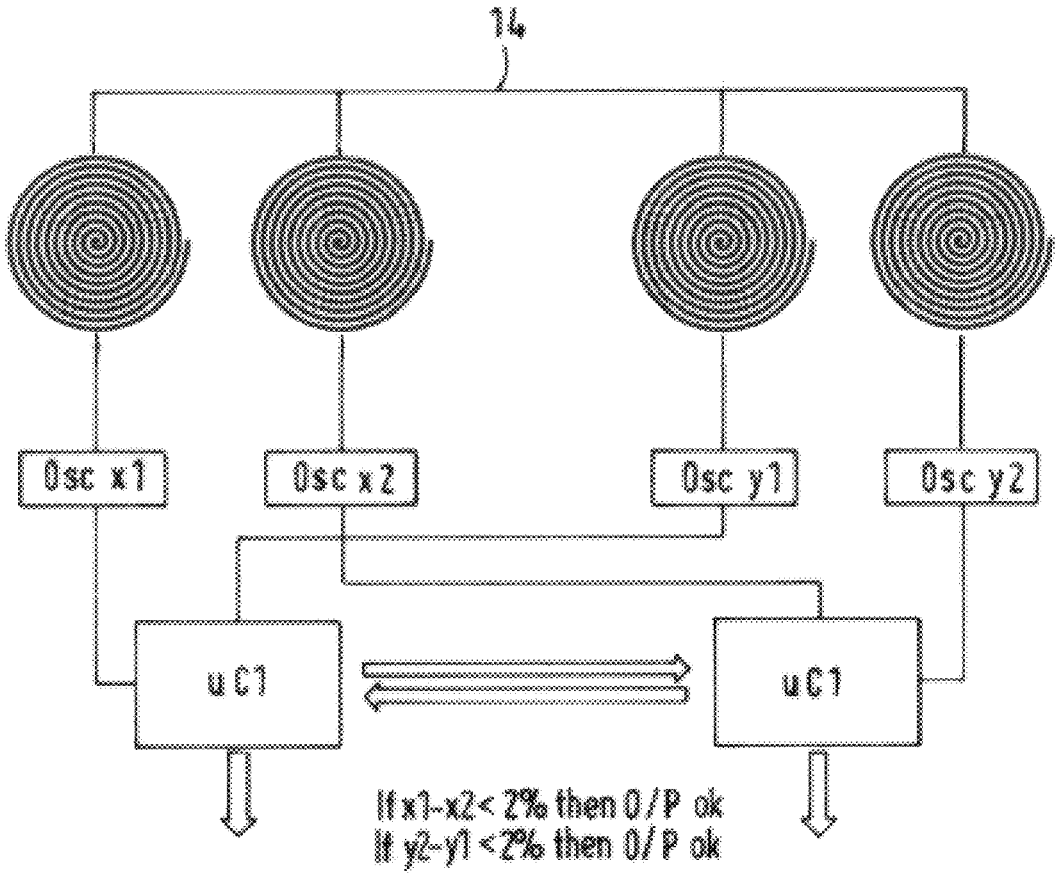
FIG. 7 shows a block diagram referring to operations of coils and microcontrollers.

FIG. 7 shows a block diagram of how operations from at least two coils 14 and at least two microcontrollers communicate with each other. The coils 14 and the microcontrollers are used for diagnostic purposes.

REFERENCES

1 joystick
2 lever
3 upper end
4 lower end
5 housing
6 collar
7 cover
8 interior

9 exterior
10 support plate
11 sensor
12 socket
13 plane of sensor
14 coil
15 slider
16 shoulder
17 slider arm
18 metal flag
19 longitudinal axis/pivot axis
20 rest position
21 pivot point
22 tilting motion
23 longitudinal side of sensor
24 longitudinal side of the sensor
25 frontside of sensor
26 distance
27 distance
28 slider arm
29 distance
30 haptic profile
31 spring load mechanism
32 spring
33 double arrow

What is claimed is:

1. A control device adapted and configured to be electrically connectable to a power operated device, the control device comprising at least one body, at least one haptic profile, at least a pair of moveable metal flags with a variable geometry, and at least one sensor electronics with planar coils, wherein the at least one body is pivotable around a central pivot point with a corresponding angular position ($\phi$) and a distance (R) from the central pivot point, the at least one body is linked to the at least one haptic profile such that the haptic profile provides a tactile feedback to a user when the body is actuated around the central pivot point, the at least one body is adapted and configured to return to its neutral state in a repeatable manner, the at least one body is linked to the at least two metal flags such that the combined motion of the flags provides a directional control in an x-direction and a y-direction based upon $R=\sqrt{(x^2+y^2)}$ and $\phi=\tan^{-1}(y/x)$; and wherein the sensor electronics with the planar coils are oriented parallel to the at least two metal flags, the sensor electronics with the planar coils are adapted and configured to generate eddy currents, the variable geometry of the at least two metal flags coupling with an oscillating magnetic field of the eddy currents.

2. The control device according to claim 1, wherein the body has the form of a lever.

3. The control device according to claim 2, wherein the flags are linked moveable with the lever in a direct manner.

4. The control device according to claim 2, wherein the flags are linked with the lever by means of a slider.

5. The control device according to claim 4, wherein a rotary motion of the slider is translated into a linear motion of the flags.

6. The control device according to claim 4, wherein the flags and the slider are arranged orthogonally relative to each other.

7. The control device according to claim 2, wherein one of the flags is linked moveable with the lever by means of a slider.

8. The control device according to claim 1, wherein the individual flags are aggregated as a set of inserted moulded flags.

9. The control device according to claim 1, wherein the body has a pivot point linked to a main housing.

10. The control device according to claim 1, wherein the haptic profile has the form of a spring load mechanism.

11. The control device according to claim 10, wherein a tactile feedback is provided by the spring load mechanism.

12. The control device according to claim 1, wherein the haptic profile has the form of a set of magnets.

13. The control device according to claim 12, wherein a tactile feedback is provided by the set of magnets.

14. The control device according to claim 1, wherein the haptic profile is an integral geometry of a housing of the body.

15. The control device according to claim 1, wherein the haptic profile is an independent component of a housing of the body.

16. The control device according to claim 1, further comprising a housing, wherein the body comprises a lever, and the housing and the lever are linked with each other in a pivot point.

17. The control device according to claim 1, wherein a loss of energy caused by the eddy currents generated by the planar coils is converted into a delta x or a delta y value, respectively.

18. The control device according to claim 1, wherein the flags are arranged at each side of the coils.

* * * * *